United States Patent [19]

Hemphill

[11] 4,251,933

[45] Feb. 24, 1981

[54] LIP AND TEETH IN COMBINATION WITH A FLAT BOTTOM BUCKET

[76] Inventor: Charles W. Hemphill, 1106 Green Valley La., Duncanville, Tex. 75116

[21] Appl. No.: 17,445

[22] Filed: Mar. 5, 1979

[51] Int. Cl.[3] ..... E02F 9/28

[52] U.S. Cl. ..... 37/141 R; 37/118 R

[58] Field of Search ..... 37/141 R, 141 T, 142 R, 37/118 R, 118 A, 103

[56] References Cited

U.S. PATENT DOCUMENTS

| | | | |
|---|---|---|---|
| 741,099 | 10/1903 | Bisbee | 37/141 T X |
| 848,743 | 4/1907 | Helm | 37/141 R UX |
| 1,540,314 | 6/1925 | Clark | 37/141 T |
| 1,642,189 | 9/1927 | Bager et al. | 37/118 R |
| 1,908,883 | 5/1933 | Black | 37/141 T |
| 2,783,558 | 3/1957 | Morgan | 37/103 UX |
| 2,972,425 | 2/1961 | Anderson et al. | 37/103 X |
| 3,184,085 | 5/1965 | Randall et al. | 37/103 UX |
| 4,037,337 | 7/1977 | Hemphill | 37/141 T X |

FOREIGN PATENT DOCUMENTS

| | | | |
|---|---|---|---|
| 725363 | 1/1966 | Canada | 37/141 T |

*Primary Examiner*—Clifford D. Crowder
*Attorney, Agent, or Firm*—Marcus L. Bates

[57] ABSTRACT

Improvements in digging apparatus, and in particular the lip and teeth of an excavating bucket for a backhoe machine. The bucket has spaced sides attached to a rear wall and a flat bottom which curves towards the rear wall. The sides and rear are joined to the bottom, and the bucket opening has a periphery defined by the upper edge portion of the rear wall, sides, and the forward edge of the teeth. The marginal, forward end of the bottom is in the form of a specially constructed bucket lip. A plurality of digging teeth are mounted individually to shanks formed at the forward end of the lip. The teeth are arranged respective to one another to provide a continuous cutting edge from one to the other side of the bucket, and the teeth are attached to the bucket lip. The geometrical configuration of the digging teeth, the bucket design, and the tooth distribution pattern increases the digging efficiency and provides a smooth excavated surface. The bucket lip transfers digging loads from the teeth into the backhoe dipper stick in an improved manner.

9 Claims, 14 Drawing Figures

LIP AND TEETH IN COMBINATION WITH A FLAT BOTTOM BUCKET

BACKGROUND OF THE INVENTION

Reference is made to my previously issued U.S. Pat. No. 4,037,337 and to the art cited therein for additional background of this invention. Reference is also made to my co-pending patent application Ser. No. 817,733, filed July 21, 1977, now U.S. Pat. No. 4,133,121.

In digging ditches, it is sometimes necessary to form the bottom of the ditch into a flat surface which often must be held within considerably close tolerance with regard to the deviation thereof from a horizontal plane. Simultaneously with the forming of a flat bottom ditch, it is also often desirable that the opposed sidewalls of the ditch immediately adjacent the bottom be cut exactly vertical with any irregularities therein being minimized. The foregoing desirable ditch is difficult to achieve using prior art excavating bucket and backhoe combinations.

It is furthermore desirable for one to be able to easily position the bucket such that the digging teeth thereof penetrate the earth at the optimum cutting angle. Another desirable feature often associated with buckets is for the structural integrity thereof to be sufficient to enable efficient operation in all sorts of geological formations with a minimum of down time being encountered for repairs. It would also be desirable to provide a bucket made into a configuration which enables it to carry a considerable volume of excavated material on the top thereof, thereby greatly increasing the actual payload of the bucket well beyond its actual displacement. In addition, it would be advantageous to have made available an improved digging tooth which encounters and excavates earth more efficiently than heretofore realized, and wherein the teeth can be easily changed in the field without employment of special tools.

The above desirable attributes are the subject of this invention.

SUMMARY OF THE INVENTION

Improvements in excavating apparatus, and in particular an improved backhoe bucket. The bucket has spaced sides attached to a rear wall and to a flat bottom. The forward part of the bucket bottom lies in a plane and the rear part of the bucket bottom describes a curve. The bottom is attached to the sides and the rear in such a manner that the cross-sectional area of the bucket increases in an upward direction and towards the opening of the bucket.

The bucket opening is described by one side edge portion of the bottom, sides, and rear wall. The rear of the bucket is provided with lift means by which the bucket can be removably attached to the dipper stick receptacle of a backhoe and manipulated in a digging manner, preferably in accordance with my previously issued U.S. Pat. No. 4,133,121. The forward marginal end of the bucket terminates in a special bucket lip made in accordance with the present invention, and to which a plurality of specially constructed digging teeth are removably mounted in a novel manner. The lip forms the forward marginal end portion of the bottom and extends from one sidewall to the other sidewall of the bucket.

Each of the centrally located digging teeth are provided with an earth-engaging cutting member which extends in advance of the bucket lip. The teeth include a rearwardly opening cavity which accepts a forwardly protruding stump made integrally with the lip, thereby providing improved load-transferring capability as well as reduced cost of manufacture and ease of tooth replacement.

The teeth are arranged in side-by-side relationship and are placed into abutting engagement with respect to one another, with the forward cutting members thereof presenting a continuous cutting edge respective to the formation being excavated.

In another embodiment of the invention, the outermost teeth are mirror images of one another, while a plurality of teeth are located therebetween and arranged along a common plane, with the adjacent teeth between the outermost teeth being identical to one another. This new construction makes available an unusual lip which is built up of individual shanks to form an integral lip which can be of any desired lateral dimension.

The forward marginal end of the bottom of the bucket lies in a plane. The rear marginal end of the bottom of the bucket is curved in a rearward direction, and lies horizontally in a lateral direction. The bottom is curved in such a manner that the optimum digging angle is easily achieved by slightly raising the rear of the bucket respective to the cutting edge of the digging teeth.

The configuration of the digging teeth cooperates with the design of the bucket to provide an improved bucket and tooth combination which complements one another to bring about unexpected advantages in the excavation art.

Critical components of the bucket are fabricated of boxed construction which provides the required structural integrity to enable the transfer of loads from the digging teeth back to the lifting means, and it is believed that this load transfer occurs in a novel manner.

Accordingly, a primary object of the present invention is the provision of an improved backhoe bucket which excavates material from the earth in such a manner that a smooth surface is obtained at the bottom of the excavation.

Another object of the invention is to provide an improved bucket which carries a considerable amount of its payload externally or on top of the bucket.

A further object of this invention is to disclose and provide an improved bucket and tooth combination which enables excavation to be achieved by performing a cutting action across the entire width of the bucket.

A still further object of this invention is to provide an excavating bucket having digging teeth arranged thereon which enables the removal of earth to be carried out in a superior manner, thereby significantly reducing the cost of the excavation operation.

Still another object of the invention is the provision of improvements in cutting members for excavating machines which includes a strong lip of hollow construction which transfers loads from the cutting edge thereof into the machine in a superior manner.

A further object of the invention is the provision of a hollow cutting tooth mated to a stump on a shank with a plurality of shanks being joined together to provide a lateral dimension of any desired width.

Another and still further object of the present invention is the provision of an improved digging bucket having the bottom and the teeth thereof arranged respective to one another such that the bucket is easily manipulated into or placed at the optimum digging angle thereof.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
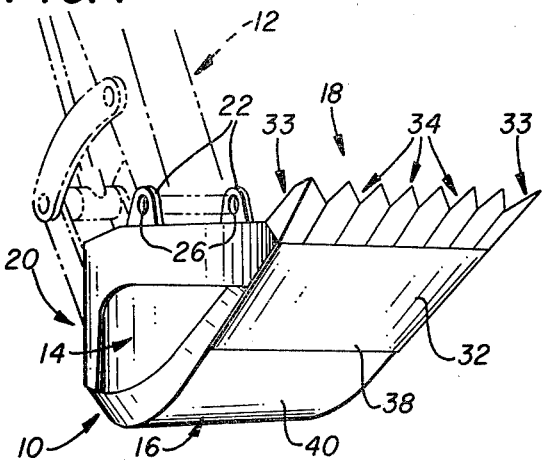
FIG. 1 is a perspective view of a digging bucket apparatus made in accordance with the present invention.
Figure 2:
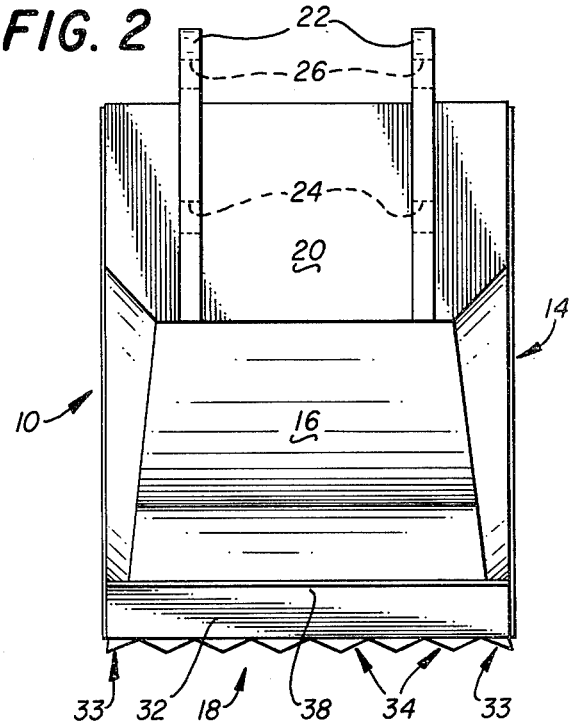
FIG. 2 is an enlarged rear view of the bucket disclosed in FIG. 1.

In FIG. 1, together with various other figures of the drawings, there is disclosed an excavating bucket 10 made in accordance with the present invention. The bucket is illustrated in attached relationship respective to the upper and lower receptacles of a dipper stick, such as may be associated with a backhoe machine, and as indicated by the dot-dash lines at numeral 12.

The bucket has opposed sides, one of which is indicated by the numeral 14, and a bottom 16. A plurality of digging teeth 18 are attached to the forward end of the bucket. The bucket includes a rear wall 20 joined to the sidewalls and to the bottom. The bottom curves from attached relationship respective to the lower end of the rear wall and forwardly towards the teeth, as illustrated in the various figures of the drawings.

Spaced-apart lifting ears 22 are attached to the rear wall of the bucket. Spaced-apart, axially aligned pairs of holes 24 and 26 are formed through the bucket ears and preferably include bushings associated therewith, as set forth in my previously filed patent application Ser. No. 817,733, filed June 21, 1977, now U.S. Pat. No. 4,133,121.

Figure 3:
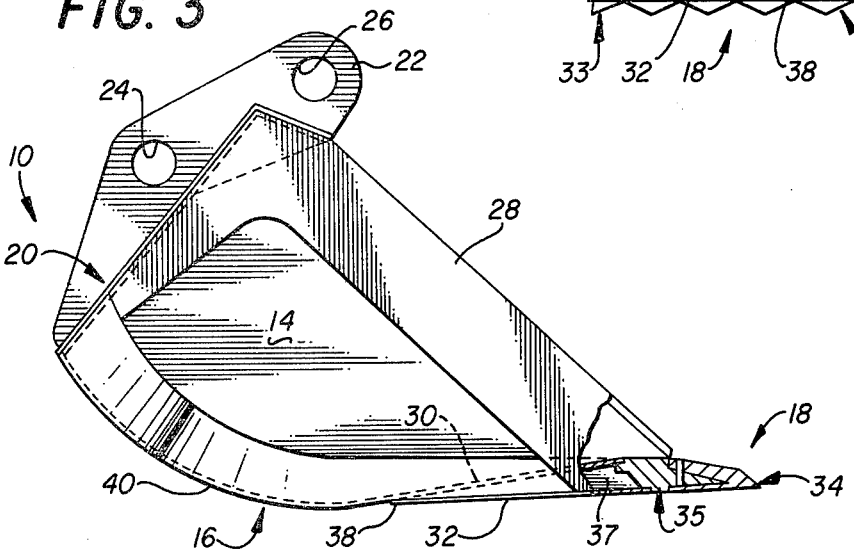
FIG. 3 is a side elevational view of the bucket illustrated in FIG. 1, with some part being broken away therefrom.
Figure 4:
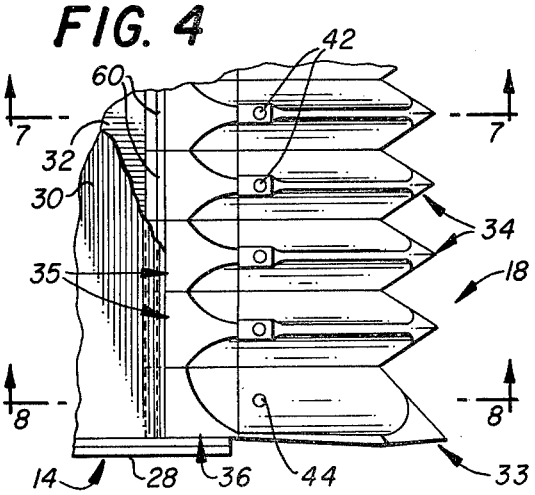
FIG. 4 is a fragmentary, top view of the bucket disclosed in the foregoing figures, with some parts being removed therefrom.
Figure 5:
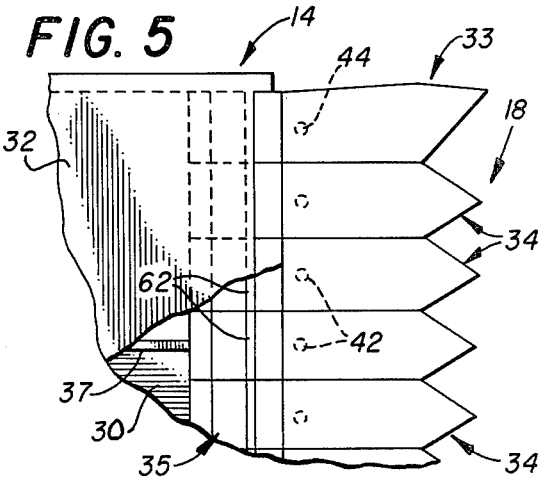
FIG. 5 is a fragmentary, bottom view of the bucket disclosed in the foregoing figures with some parts thereof being removed therefrom so as to disclose some of the interior parts thereof.
Figure 6:
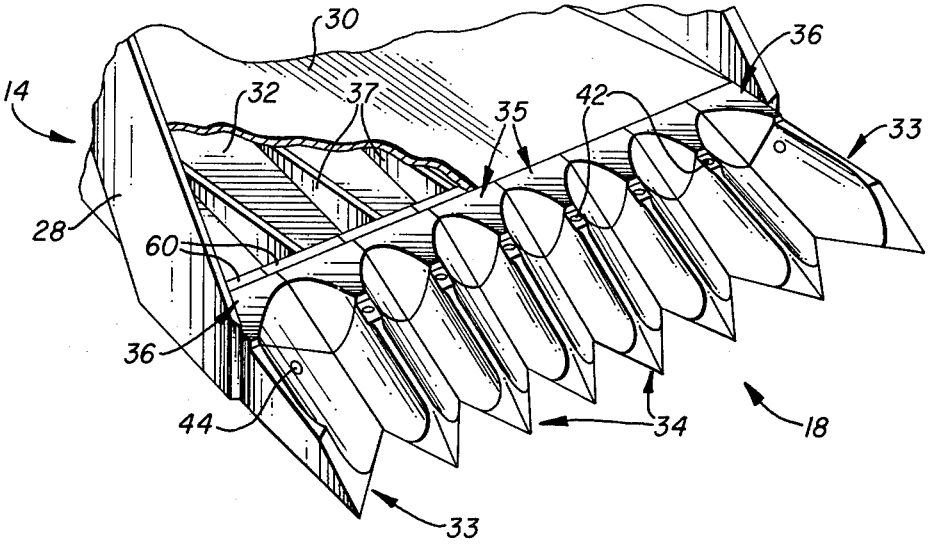
FIG. 6 is a broken, perspective view of the bucket disclosed in the foregoing figures, with some parts being broken away therefrom, and some of the remaining parts being shown in cross-section.

Each sidewall of the bucket is provided with a reinforcement 28 which is in the form of an inverted L, as best seen illustrated in FIGS. 1, 3, and 4. The bottom of the bucket includes an upper or interior plate 30 which is spaced from an exterior or bottom plate 32. The two plate members form part of the marginal forward end of the bucket, as will be better appreciated later on in this disclosure.

The teeth 18 include opposed, spaced-apart, outermost teeth 33 separated from one another by a plurality of adjacently arranged, centrally located teeth 34. The central teeth are removably attached to a plurality of shanks 35, while the outermost teeth are attached to the spaced shanks 36. The opposed shanks 36 are mirror images of one another, while the centrally located shanks 35 are identical in construction. The shanks form the lip of the bucket, and form a subcombination of this invention, as will be discussed in greater detail later on in this disclosure.

As best seen illustrated in FIGS. 3, 5, 6, 13, and 14, longitudinally disposed, vertically aligned, spaced-apart ribs 37 are welded to the interior and exterior bottom plate members. The plate members have a trailing edge which is welded together at apex 38, and have a marginal, forward end portion welded at vertically spaced-apart positions on the rear of the shank. The upper plate member 30 continues rearwardly at 40 at the bottom of the bucket and into engagement with a lower, lateral edge portion of the rear wall 20.

Pins 42 are received through apertures 44, with the apertures being formed through both the teeth and the shank, thereby enabling removal of any one tooth from mounted relationship respective to the shank part of the lip, to which it is attached.

As seen in FIGS. 9–12, together with other figures of the drawings, the individual shanks include a forwardly directed stump having opposed sidewalls 46 and 48 which join an upwardly sloped wall, as indicated by numeral 50, and include a reduced terminal end portion 52. The shank includes an uppermost surface 53 which extends from end portion 52 and terminates in attached relationship to a vertical shoulder 54. Numeral 55 indicates the upper edge portion of the shoulder 54, and the beginning of the uppermost wall surface of the individual shank.

The shank is provided with a rear wall 56 opposed to the forward end 52 thereof. The sidewalls 57 and 59 are separated from one another by the upper, relatively flat face 58 which extends from edge portion 55 towards the rear wall 56. Welding grooves 66 are placed at the interface formed between the abutting sides 57 and 59 of the abutting adjacent shanks.

Spaced-apart, lateral steps 60 and 62 have a thickness substantially equal to plate members 30 and 32 and are formed in the marginal upper and lower rearward edge portions of the shank for accommodating the spaced-apart plate members 30 and 32. The steps 60 and 62 are parallel and offset from one another, with the lower step 62 being located forwardly of the upper step 60. Sloped wall 64 upwardly and then rearwardly slopes towards the rear wall 56.

Figure 7:
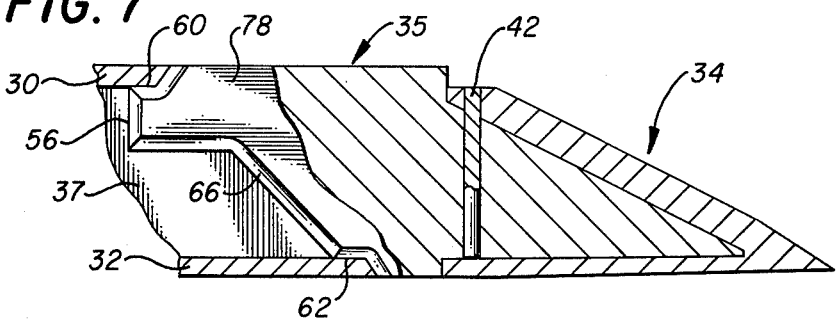
FIGS. 7 and 8 are enlarged, fragmentary, part cross-sectional views of part of the apparatus disclosed in the foregoing figures.
Figure 8:
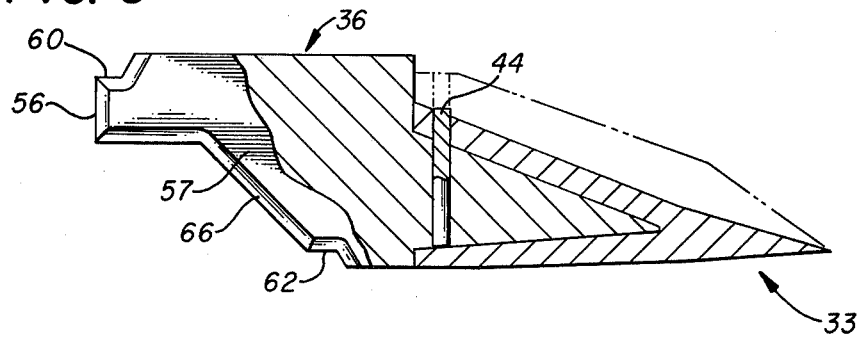
Figure 14:
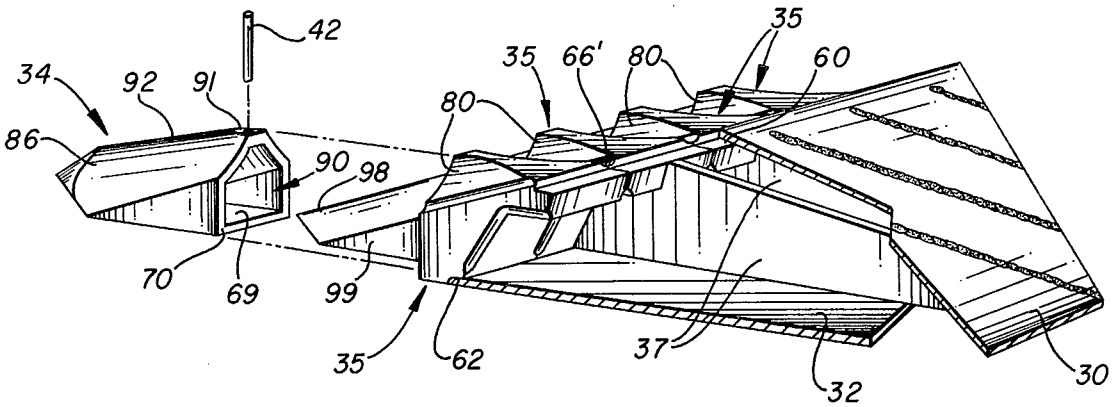

As best seen in FIGS. 7 and 8, together with other figures of the drawings, the intervening interface between abutting shanks is provided with a welding groove 66 which enables the adjacent shanks to be completely tied together by a welding bead 66', as seen in FIG. 14, for example.

Each tooth has a hollow, rearwardly opening socket or cavity 68 made into a configuration which accepts the forwardly extending stump member of the shank. The cavity includes a bottom wall 69 and has an opening defined by the rearwardly located shoulder 70 at the terminal rear end of the tooth. The rear wall or rear shoulder abuttingly engages the forward shoulder 54 of the shank, thereby providing a load transfer member about an entire marginal peripheral surface area of both the tooth and the shank. Numeral 71 indicates the uppermost part of the tooth which is a continuation of the upperface 58 of the shank, the two surfaces being joined at interface 55.

Figure 9:
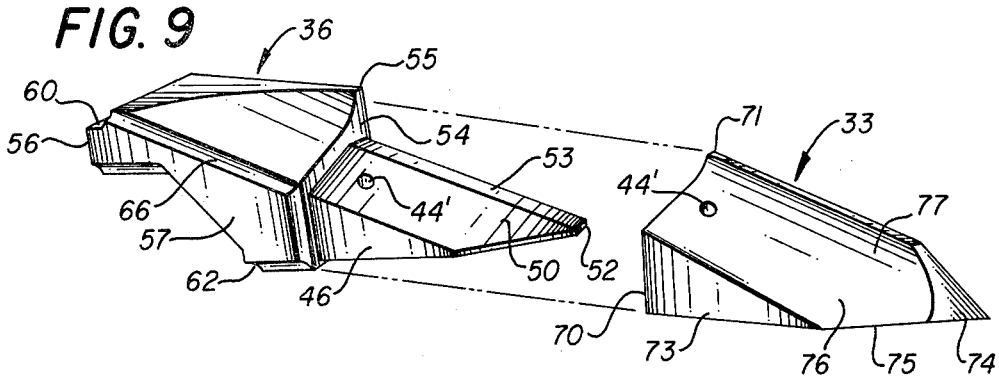
FIGS. 9–12 are isolated, disassembled, enlarged, perspective views of part of the apparatus disclosed in the foregoing figures.
Figure 10:
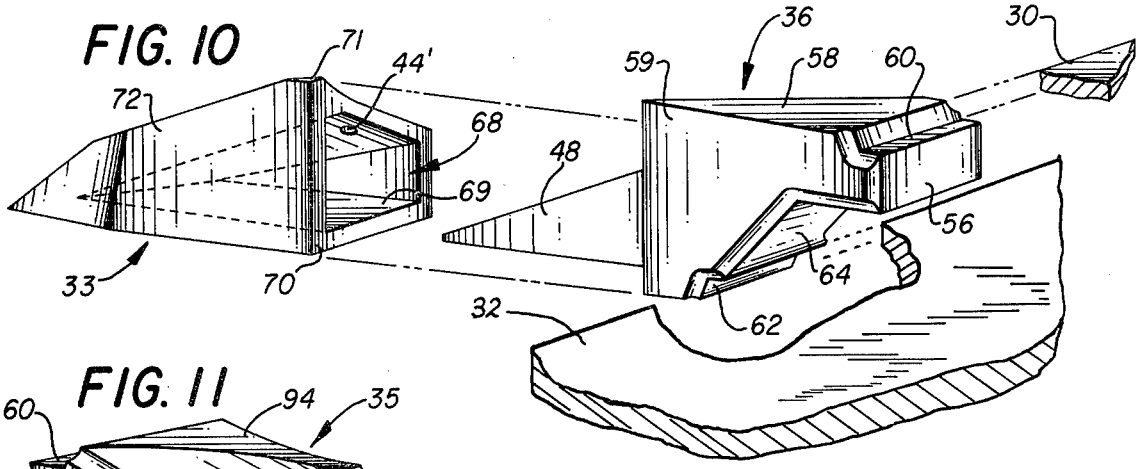

As seen in FIG. 9, the tooth 33 is provided with an upper surface 71 which adjoins the shank 36 and continues as the upperface 55 thereof.

The outermost teeth of the present invention have substantially vertical tall sides 72 and short sides 73, and an inclined, primary earth-engaging surface 74, with the frontal part of the tooth being joined to the side 73 by a cutting edge 75. The cutting edge defines the forward end portion of the teeth and includes a curved face 76 which rearwardly extends to the rear wall 70 thereof. The curved surface 76 continues to increase in curvature at 77 at a location near the upper surface 71 thereof.

Figure 11:
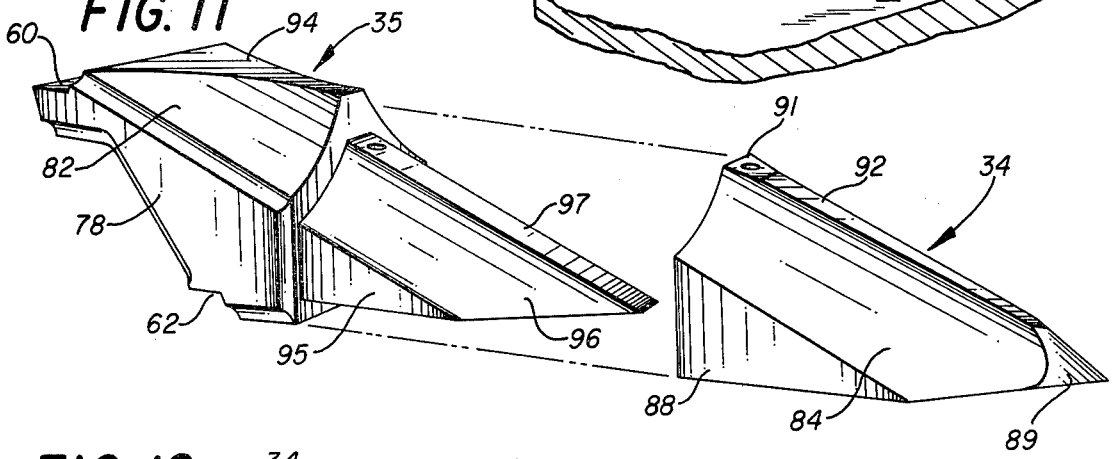
Figure 12:
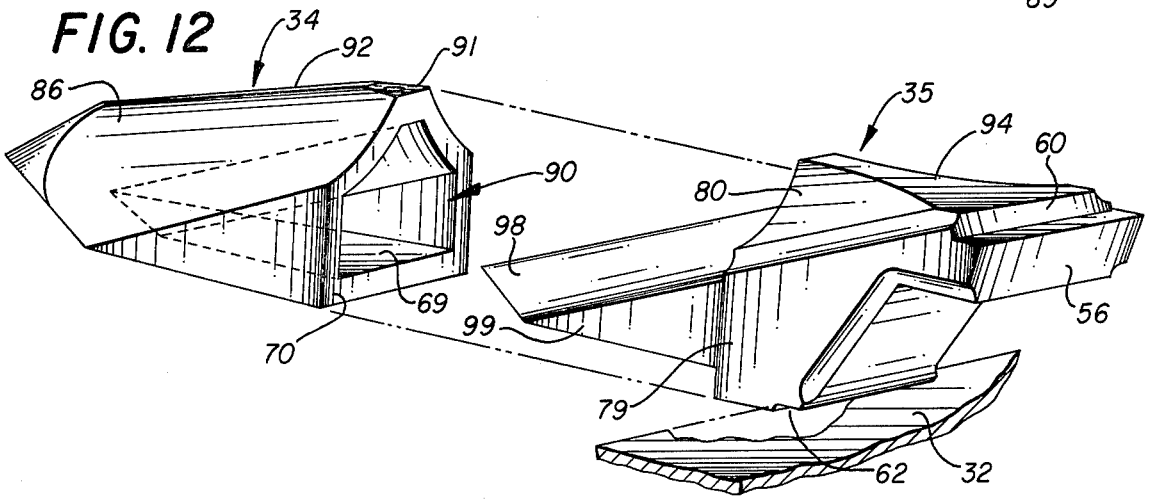
Figure 13:
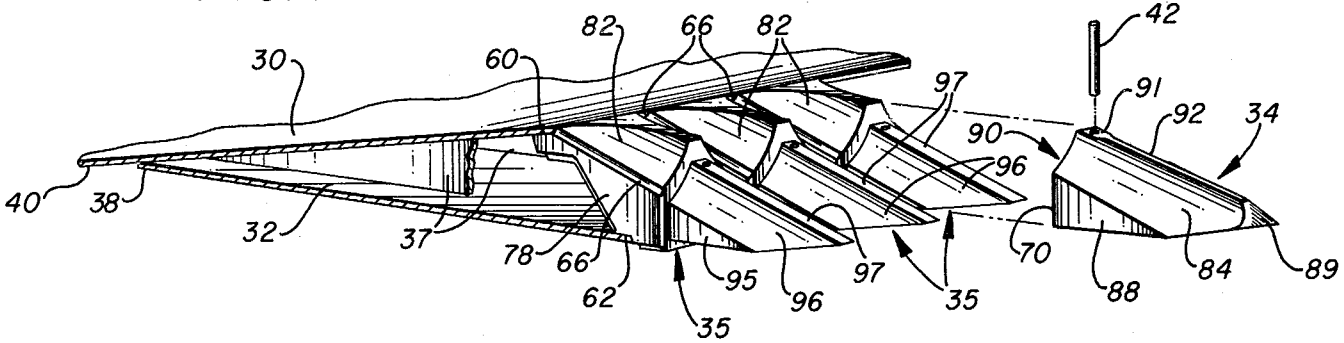
FIG. 13 is a part cross-sectional, part disassembled, frontal view of part of the apparatus disclosed in FIG. 1; and, FIG. 14 is a part cross-sectional, part dissembled, rear view of part of the apparatus disclosed in FIG. 13.

In FIGS. 11 and 12, the shank of the central teeth is seen to include spaced-apart vertical sides 78 and 79 of substantially equal height which abuttingly engage adjacent central shanks. Opposed surfaces 80 and 82 upwardly curve towards one another and continue forwardly as a curved tooth surface 84 and 86 when the tooth is mated to the shank. The tooth has opposed, substantially vertical sidewalls, one of which is seen at 88, which coincides with the vertical sidewalls 78 and 79 of the shank, when the tooth is mated thereto.

The tooth is formed with a hollow interior 90 made complementary respective to the forwardly directed stump or male portion of the shank. The floor 69 of the hollow interior of the tooth coincides in elevation with the remaining floors of the remaining teeth. Uppermost surface 91 of the tooth makes a smooth transition from the central surface 92 and 94 of the tooth and the shank, respectively, and facilitates installation of the keeper pin. Sidewalls 96–98 of the shank stump receive the corresponding complementary shaped sidewalls of the tooth cavity in close tolerance relationship therewith, in order to transfer the loads received from the forward end of the tooth into the bucket lip.

The bucket lip of the present invention includes the integral, built-up shank assembly and can be made any lateral dimension desired by choosing the number of central shanks to be welded together and to the outer shanks. The shanks are laterally and longitudinally aligned with one another, thereby presenting a groove 66 between each adjacent tooth which enables a welding bead to be formed completely thereabout, thereby tying each of the shanks together into a unitary tooth-receiving lip having a forwardly extending male protrusion or stump upon which there is mounted a hollow digging tooth having a cavity made complementary respective to the protrusion. The digging forces encountered by the tooth is thereby transferred into the lip by advantageously taking advantage of the coacting interfaces 46, 48, 50, 53, 54 and 70. The pin received through aperture 44' wedgedly holds the tooth to the shank protuberance.

OPERATION

In operation, the excavating bucket of the present invention is attached to a digging implement, such as the dipper stick of a backhoe machine. The flat bottom bucket has a continuous cutting edge at 33 and 34 which extends from one to the other side thereof, while the edge portion of member 28, which forms part of the peripheral opening into the bucket, provides the function of a blade member. Accordingly, when the bucket is positioned as seen in FIG. 3, the bottom 16 and teeth 33, 34 thereof can be positioned respective to the ground to cause movement of the bucket in a forward direction to force the continuous cutting edge to engage the ground at the optimum angle for forming a continuous smooth surface or excavation of minimum irregularities. Simultaneously with forming a smooth bottom of a ditch or the like, the edges of member 28 engage the sidewalls of the ditch and remove irregularities therefrom.

The angle bracket 28 and bottom 30, 32 efficiently transfers the load between the digging teeth and the lifting means. The boxed construction seen at 28, 30, 32, 35, 37 reinforces the marginal front end of the bucket and enables tremendous power to be transferred from the dipper stick into the teeth.

The unitary shank construction is tied into the bottom and sidewalls of the forward marginal end of the bucket by the provision of the spaced-apart floor 30 and bottom 32 to thereby provide a triangular construction having an apex at 38, with the unitized shanks forming the base of the triangle. The ribs 37 are attached to both the upper and lower plates as well as to the shank, thereby reinforcing the structure and uniformly transferring the loads encountered by the digging action into the bottom and sides of the bucket.

The spaced-apart side angle members 28 extend from opposed sides of the unitary lip rearwardly into the rear wall of the bucket. The rear wall of the bucket transfers the digging load into the lifting ears 22, which in turn transfers the load into the backhoe dipper stick receptacles. The lip and tooth construction of the present invention can be extended in utility so that it can be used in conjunction with other digging machines; such as, for example, scrappers, backloaders, and ditching machines.

A significant saving in cost and efficiency is realized by the provision of a hollow tooth made in accordance with the present invention for the reason that advantage is taken of the tooth mounting means so that a lightweight but strong tooth is realized.

The tooth can be fabricated from expensive alloys without significantly increasing the cost thereof. At the same time, the configuration of the interior of the hollow tooth advantageously transfers loads into the shank in a superior manner.

The provision of a bucket having a hollow construction adjacent to the unitized bucket lip greatly increases the structural integrity of the bucket while conserving the gross weight thereof, thereby demanding less lifting power from the backhoe machine.

The continuous cutting edge provided by the joint action of the laterally arranged teeth lowers the power requirements demanded by the backhoe machine during the excavating operation and enables an increase in digging efficiency to be realized therefrom.

The configuration of the bucket makes possible a much greater capacity than is evidenced by the actual displacement of the interior thereof for the reason that excavated material continues to be directed from the teeth to a location on top of the bucket so that as the bucket is curled, a significant amount of excavated material is carried in a heap at the top thereof which commences at the cutting edge of the teeth and extends upwardly in a slope and then downwardly towards the rear of the bucket.

The novel concept of providing a continuous cutting edge forwardly of a unitized lip, with the loads from the cutting edges being transferred into a box construction, and from the box construction into the mount means therefor, provides a rugged bucket which can be used to dig in rock as well as digging in plastic-like material, such as clays.

I claim:

1. An excavating bucket having a unitary tooth supporting lip at the forward end thereof, said lip comprising a plurality of tooth supporting shanks arranged in side by side abutting relationship and rigidly joined together, each shank having a forwardly directed stump, a shoulder formed about said stump at the location where the stump is joined to the shank, said shoulder lying in a plane which extends laterally of the bucket;

said stump deminishes in cross-sectional area in a forward direction and has an outer surface defined by a plurality of walls with the walls converging towards one another in a forward direction;

a digging tooth removably mounted on each stump, said tooth having a rearwardly opening cavity made complementary respective to said stump so that the walls forming the cavity abuttingly engage the walls forming the stump; the cavity opening being defined by a tooth shoulder lying in a plane which extends laterally of the bucket and which abuttingly engages the shoulder formed about the stump;

said tooth includes opposed sidewalls arranged longitudinally of the bucket, said stumps being spaced laterally respective to one another an amount which causes the sidewalls of adjacent teeth to substantially slidably engage one another;

each of said teeth include means forming a cutting edge at the forward end thereof, said cutting edge commences at the forwardmost ground engaging part of the tooth and extends rearwardly to the tooth sidewall; with the cutting edges of the teeth cooperating together to form a continuous cutting edge which extends across the entire width of the bucket;

and fastener means by which each of said teeth are affixed to a shank in a removable manner.

2. The bucket of claim 1 wherein the outermost of said plurality of teeth have a flat vertically aligned side which terminates forwardly in said cutting edge and terminates rearwardly in said tooth shoulder;

said outermost teeth being mirror images of one another while the centrally located teeth which are mounted between said outermost teeth are identical to one another.

3. The bucket of claim 1 wherein said shanks have a top, bottom, rear, and sidewalls, said sidewalls are vertically disposed and arranged longitudinally of the bucket; said sidewalls abuttingly engage one another and are rigidly affixed to each other to present the aforesaid unitary lip structure.

4. The bucket of claim 3 wherein there is a laterally arranged lower step formed along the rear edge of the bottom wall, and a laterally arranged upper step formed along the rear edge of the top wall, said rear wall commences at the lower step and slopes upwardly and rearwardly towards the upper step;

an interior plate member having a forward edge attached to the upper step; an exterior plate member having a forward edge attached to the lower step; each plate member having a rear edge joined together at a location spaced rearwardly of the shanks;

a plurality of vertical web members having the edges thereof affixed to said rear wall, exterior plate member, and interior plate member.

5. The bucket of claim 1 wherein said lip lies in a plane which extends rearwardly and then curves upwardly towards the bucket rear wall;

wherein the outermost of said plurality of teeth have a flat vertically aligned side which terminates forwardly in said cutting edge and terminates rearwardly in said tooth shoulder;

said outermost teeth being mirror images of one another while the centrally located teeth which are mounted between said outermost teeth are identical to one another;

said shanks have a top, bottom, rear, and sidewalls, said sidewalls are vertically disposed and arranged longitudinally of the bucket; said sidewalls abuttingly engage one another and are rigidly affixed to each other to present the aforesaid unitary lip structure;

wherein there is a laterally arranged lower step formed along the rear edge of the bottom wall, and a laterally arranged upper step formed along the rear edge of the top wall, said rear wall commences at the lower step and slopes upwardly and rearwardly towards the upper step;

an interior plate member having a forward edge attached to the upper step; an exterior plate member having a forward edge attached to the lower step; each plate member having a rear edge joined together at a location spaced rearwardly of the shanks;

a plurality of vertical web members having the edges thereof affixed to said rear wall, exterior plate member, and interior plate member;

an angle reinforcement located on each side of the bucket and which is affixed to opposed sides of the bucket lip, and extends rearward into attached relationship respective to the bucket rear wall.

6. In a backhoe bucket having spaced sides, a rear wall, and a flat bottom which commences at the rear wall and curves downwardly and forwardly into a tooth supporting lip which lies in a plane;

the sides and rear wall being joined together and to the bottom, with the bucket having an opening defined by a peripheral edge which includes the outermost edges of the sides and rear wall, and the tooth-supporting lip; lift means attached to the bucket by which the bucket can be lifted and manipulated; the improvement comprising:

said lip is comprised of an integral main body made of a plurality of shanks; a plurality of forwardly directed stumps made integrally therewith, with said stumps being spaced from one another and arranged laterally respective to the bucket; said lip forms the forward marginal part of said bucket bottom, said lip having opposed ends attached to said sidewalls of the bucket; a plurality of ground engaging teeth, each tooth having a rear wall opposed to a forward cutting member, said rear wall extends laterally of the bucket and forms a tooth shoulder, said tooth shoulder defines a stump receiving cavity within the rear marginal part of the tooth;

said tooth includes opposed sidewalls arranged longitudinally of the bucket, said stumps being spaced laterally respective to one another an amount which causes the sidewalls of adjacent teeth to substantially slidably engage one another;

each of said teeth being positioned laterally respective to one another, the cutting edges of said forward cutting member of said teeth jointly cooperate together to form a substantially continuous cutting edge across the entire width of the bucket;

so that when the bucket is moved in a forward direction, the teeth can jointly engage and remove material from the earth and cause the removed material to be received within the bucket.

7. The bucket of claim 6 wherein said lip is of boxed construction and includes an interior and exterior plate members which are spaced from one another at the forward end thereof and which are joined together at the rear end thereof; a plurality of vertically disposed rib members extending longitudinally of the bucket and affixing the exterior and interior plate members to the shanks;

angle members affixed to either side of the bucket sidewalls and defining the outer edges of each said sidewall, with one end of the angle member being affixed to said lip, another end of said angle member being attached to said bottom, and another end of said angle member being attached to said rear wall.

8. In an excavating bucket having sidewalls joined to a rear wall and to a bottom to form an outwardly opening, load receiving interior; a bucket lip formed at the leading marginal edge of the bucket, lifting means by which the bucket can be manipulated, and a plurality of digging teeth including means by which said teeth are supported by said lip, the improvement comprising:

said lip being an integral structure and lying substantially in a plane, said bottom joining said lip and rear wall with said bottom being in the form of a curved member which commences in attached relationship respective to the rear wall and curves forwardly into attached relationship to said lip;

said lip includes a main body which extends laterally across the forward end of the bucket from attached relationship respective to one sidewall into attached relationship respective to the other sidewall, a plurality of laterally spaced stumps attached to and extending forwardly from said main body; means forming a stump shoulder where each stump joins said main body;

said stump diminishes in cross-sectional area in a forward direction and has an outer surface defined by a plurality of walls which converge towards one another in a forward direction;

said digging teeth each include a marginal, forward digging end for engaging and excavating the ground, and a rear marginal mounting end by which each of the teeth are mounted to said lip; said mounting end includes a cavity made complementary respective to said stump for receiving said stump in close tolerance relationship therewithin;

each said tooth being of integral construction and having said forward digging end spaced from the rear end by spaced sidewalls; said cavity having an interior wall surface which terminates in spaced relationship respective to said digging end, and which terminates at the rear end in a tooth shoulder, wherein said tooth shoulder is in the form of a peripheral edge portion which defines the opening into the cavity;

said stump shoulder abuttingly engages said tooth shoulder when said stump is received within said cavity; with the sidewalls of adjacent teeth substantially abutting one another so that the cutting edges of the teeth jointly cooperate together to extend across the entire width of the bucket.

9. In an excavating apparatus having sidewalls joined to a rear wall and to a bottom to form an outwardly opening, load receiving interior; a lip formed at the leading marginal edge of the excavating apparatus, means by which the excavating apparatus can be manipulated, and a plurality of digging teeth including means by which said teeth are removably supported by said lip, the improvement comprising:

said lip includes a main body which extends laterally across the forward end of the excavating apparatus from attached relationship respective to one sidewall into attached relationship respective to the other sidewall, a plurality of laterally spaced stumps attached to and extending forwardly from said main body; means forming a stump shoulder where each stump joins said main body;

said lip being an integral structure and lying substantially in a plane; said bottom joining said lip and rear wall, with said bottom commencing in attached relationship respective to the rear wall and extending forwardly into attached relationship to said lip;

said stump diminishes in cross-sectional area in a forward direction and has an outer surface defined by a plurality of walls which converge towards one another in a forward direction;

said digging teeth each include a marginal, forward digging end for engaging and excavating the ground, and a rear marginal mounting end by which each of the teeth are mounted to said lip; said mounting end includes a cavity made complementary respective to said stump for receiving said stump in close tolerance relationship therewithin;

each of said teeth being of integral construction and having said forward digging end spaced from the rear end by spaced sidewalls; said cavity having an interior wall surface which terminates forwardly in spaced relationship respective to said digging end, and which terminates rearwardly in a tooth shoulder, wherein said tooth shoulder is in the form of a peripheral edge which defines the opening into the cavity;

said stump shoulder abuttingly engages said tooth shoulder when said stump is received within said cavity; with the sidewalls of adjacent teeth substantially abutting one another so that the leading edge of the lip is substantially precluded from engaging material to be excavated during the act of excavating the material.

* * * * *